US008447062B2

(12) United States Patent
Lin

(10) Patent No.: US 8,447,062 B2
(45) Date of Patent: May 21, 2013

(54) EARPHONE ASSEMBLY

(75) Inventor: Chung-Shiang Lin, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 142 days.

(21) Appl. No.: 13/109,001

(22) Filed: May 17, 2011

(65) Prior Publication Data

US 2012/0170789 A1 Jul. 5, 2012

(30) Foreign Application Priority Data

Dec. 29, 2010 (CN) ..... 2010 1 0612703

(51) Int. Cl.
*H04R 1/10* (2006.01)

(52) U.S. Cl.
CPC ..... *H04R 1/10* (2013.01); *H04R 2205/022* (2013.01)
USPC ..... 381/384; 381/370

(58) Field of Classification Search
None
See application file for complete search history.

(56) References Cited

U.S. PATENT DOCUMENTS 3,634,915 A * 1/1972 Alberts ..... 24/402
3,711,903 A * 1/1973 Brown ..... 24/401
3,825,978 A * 7/1974 Sakalys ..... 24/410
5,517,733 A * 5/1996 Chao ..... 24/427
5,949,026 A * 9/1999 DeFlorio ..... 174/117 R
6,065,192 A * 5/2000 Wang ..... 24/401
6,070,306 A * 6/2000 Wang ..... 24/436
6,327,755 B1 * 12/2001 Wang ..... 24/436
6,909,050 B1 * 6/2005 Bradford ..... 174/110 R
7,348,490 B2 * 3/2008 Sakai ..... 174/113 R
8,269,110 B2 * 9/2012 Scifo et al. ..... 174/135
8,269,111 B2 * 9/2012 Scifo et al. ..... 174/135
2005/0069147 A1 * 3/2005 Pedersen ..... 381/74
2006/0282995 A1 * 12/2006 Liou ..... 24/389
2008/0052880 A1 * 3/2008 Sullivan ..... 24/418
2009/0303667 A1 * 12/2009 Scifo et al. ..... 361/679.01
2011/0010894 A1 * 1/2011 Honeycutt ..... 24/3.1
2011/0162883 A1 * 7/2011 Groset et al. ..... 174/70 R
2012/0045084 A1 * 2/2012 Groset et al. ..... 381/384

* cited by examiner

*Primary Examiner* — Duc Nguyen
*Assistant Examiner* — Sean H Nguyen
(74) *Attorney, Agent, or Firm* — Altis Law Group, Inc.

(57) ABSTRACT

An exemplary earphone assembly includes an electrical connector, two earphones, and two cords electrically connecting the electrical connector with the earphones. Each of the cords includes two wires connecting the electrical connector with a corresponding earphone and a zip chain containing the wires. The zip chain of each cord includes an elongated main body, and a first latching part and a second latching part protruding from the main body towards the other cord. A receiving groove is defined between the first and second latching parts for receiving the second latching part of the other cord when the two cords are engaged with each other in such a manner that the first and second latching parts of one cord block the second latching part of the other cord from escaping from the receiving groove.

17 Claims, 3 Drawing Sheets

EARPHONE ASSEMBLY

BACKGROUND

1. Technical Field

The disclosure relates to earphone assemblies, and particularly to an earphone assembly including two earphones connected to a signal source via a corded connection.

2. Description of Related Art

A conventional earphone assembly includes two earphones, a first cord, a second cord, a third cord, and a plug. The first and second cords have first ends connected to the earphones, respectively, and have second ends electrically coupled together by a connector. The third cord has a first end electrically coupled to the connector and a second end terminating in the plug for docking to an audio source.

Lengths of the first and second cords are fixed due to the connector connecting the first, second and third cords together. Therefore, it is inconvenient for a user to share music from the one audio source with another person due to the fixed lengths of the first and second cords.

What is needed, therefore, is an earphone assembly which can overcome the above-described problems.

BRIEF DESCRIPTION OF THE DRAWINGS

Many aspects of the present embodiments can be better understood with reference to the following drawings. The components in the drawings are not necessarily drawn to scale, the emphasis instead placed upon clearly illustrating the principles of the present embodiments. Moreover, in the drawings, like reference numerals designate corresponding parts throughout the various views.

DETAILED DESCRIPTION

Figure 1:
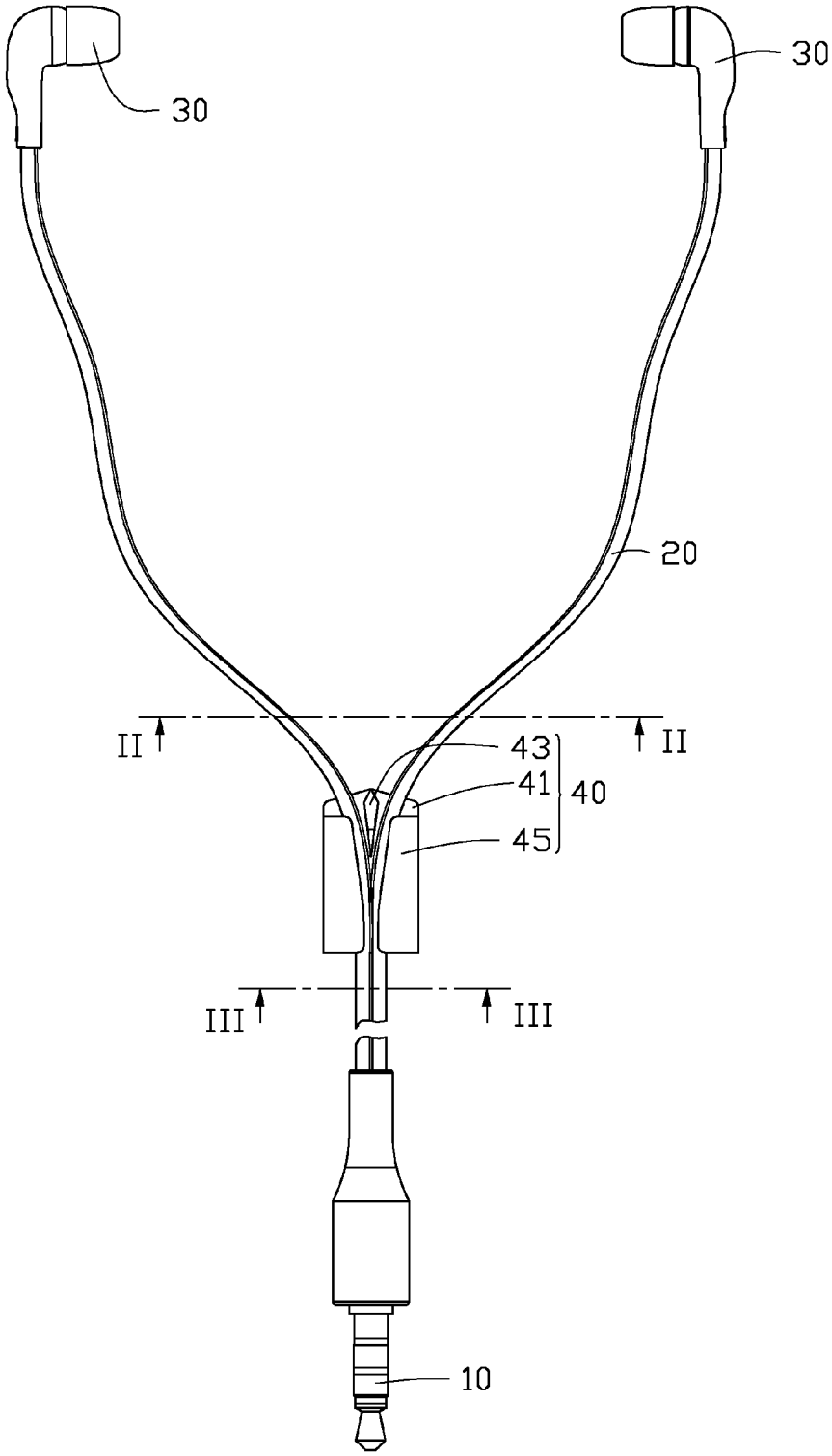
FIG. 1 is a schematic view of an earphone assembly in accordance with an embodiment of the disclosure, wherein the earphone assembly includes two separable cords partially coupled together.

Referring to FIG. 1, an earphone assembly in accordance with an embodiment of the disclosure is illustrated. The earphone assembly includes two earphones 30, an electrical connector 10, two separable cords 20 electrically connecting the electrical connector 10 with the earphones 30, respectively, and a zipper 40. The cords 20 are coupled together as a unified strand when zipped up by the zipper 40. The cords 20 are separated from each other as two separate strands when unzipped by the zipper 40.

The electrical connector 10 can connect the earphone assembly to an audio source such that electrical signals from the audio source can be conveyed through the cords 20 to the earphones 30. In the illustrated embodiment, the electrical connector 10 is an electrical plug. Transducers in the earphones 30 convert the electrical signals to audible sound. The transducers can for example be audio loudspeakers, which convert electrical voltage variations representing music or speech to mechanical cone vibration. The cone vibration vibrates the surrounding air, thus creating sound.

Figure 2:
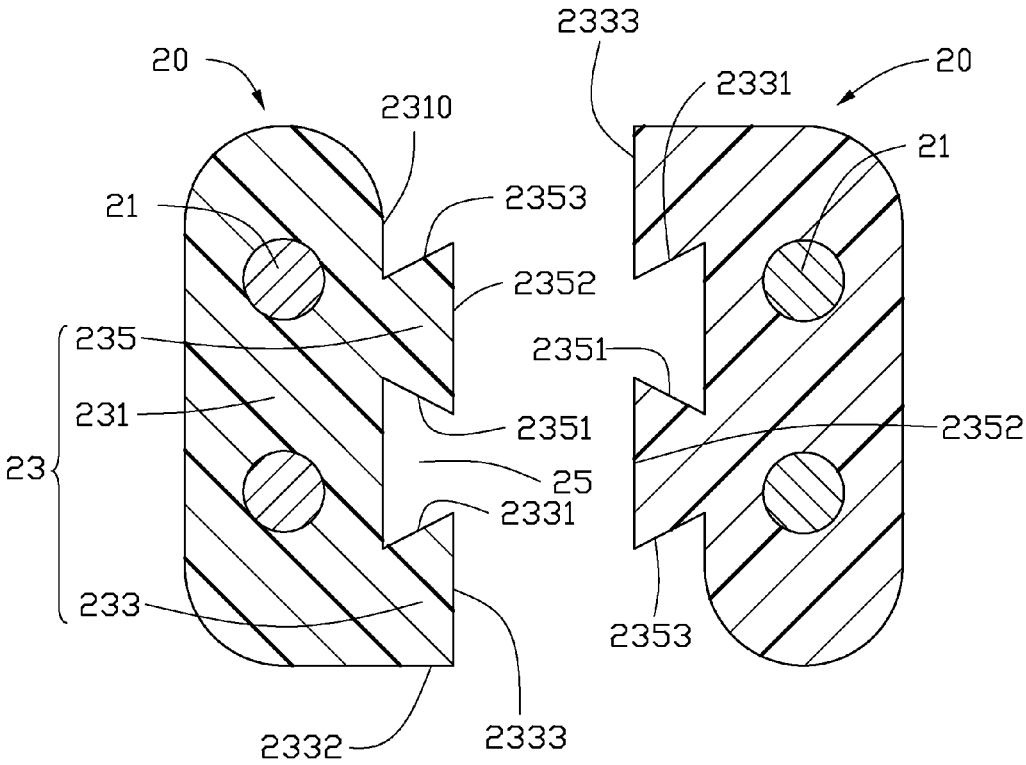
FIG. 2 is essentially an enlarged cross section of the cords of the earphone assembly of FIG. 1, taken along line II-II thereof, whereat the cords are separate from each other.

Referring also to FIG. 2, each of the cords 20 includes an elongated zip chain 23, and two metal wires 21 embedded in the zip chain 23. The metal wires 21 electrically connect the electrical connector 10 with a corresponding earphone 30. The zip chain 23 is integrally made of soft, electrically insulative material. In this embodiment, the zip chain 23 has a solid configuration and is made of rubber.

The zip chain 23 includes an elongated main body 231, a first latching part 233, and a second latching part 235. A cross section of the main body 231 is approximately rectangular. In particular, a shape of the cross section has two opposite straight sides, one end that is substantially semicircular, and an opposite end that has a right-angled corner and a substantially arc-shaped corner. The wires 21 are packed (embedded) in the main body 231 and spaced from each other. The wires 21 extend along a lengthwise direction of the main body 231. The first and second latching parts 233, 235 protrude outwards from one of the straight (i.e., flat) sides of the main body 231, i.e., from an inner flat side 2310 of the main body 231 which faces the other cord 20. The first and second latching parts 233, 235 of each zip chain 23 are parallel to and spaced from each other. Each of the first and second latching parts 233, 235 has a strip-shaped configuration.

The first latching part 233 has a right trapezoid cross section, and includes a flat lateral surface 2332 vertical to the inner flat side 2310 of the main body 231, an inclined lateral surface 2331 forming an acute angle with respect to the inner flat side 2310, and an outer surface 2333 connected between the lateral surfaces 2332 and 2331. The outer surface 2333 is parallel to the inner flat side 2310 of the main body 231. A width of the first latching part 233 in the cross section gradually increases along a direction from the inner flat side 2310 of the main body 231 to the outer surface 2333. The flat lateral surface 2332 of the first latching part 233 connects to said opposite end of the main body 231.

The second latching part 235 has an isosceles trapezoid cross section. A width of the cross section of the second latching part 235 increases along a direction away from the main body 231. The second latching part 235 includes two inclined surfaces 2351, 2353 respectively extending outwards from the inner flat side 2310 of the main body 231, and an outer surface 2352 connected between the inclined surfaces 2351, 2353. The inclined surfaces 2351, 2353 each form an acute angle with respect to the inner flat side 2310 of the main body 231. In this embodiment, the acute angles of the inclined surfaces 2351, 2353 with respect to the inner flat side 2310 are identical. In addition, such common acute angle is substantially equal to the acute angle between the inclined surface 2331 of the first latching part 231 and the inner flat side 2310. The outer surface 2352 of the second latching part 235 is coplanar with the outer surface 2333 of the first latching part 231. A receiving groove 25 is defined between the inclined surface 2331 of the first latching part 231 and the inclined surface 2351 of the second latching part 235. The receiving groove 25 has a shape and size similar to those of the second latching part 235. In detail, the receiving groove 25 is a dovetail groove, and has a cross section gradually converging outwards from the main body 231.

Figure 3:
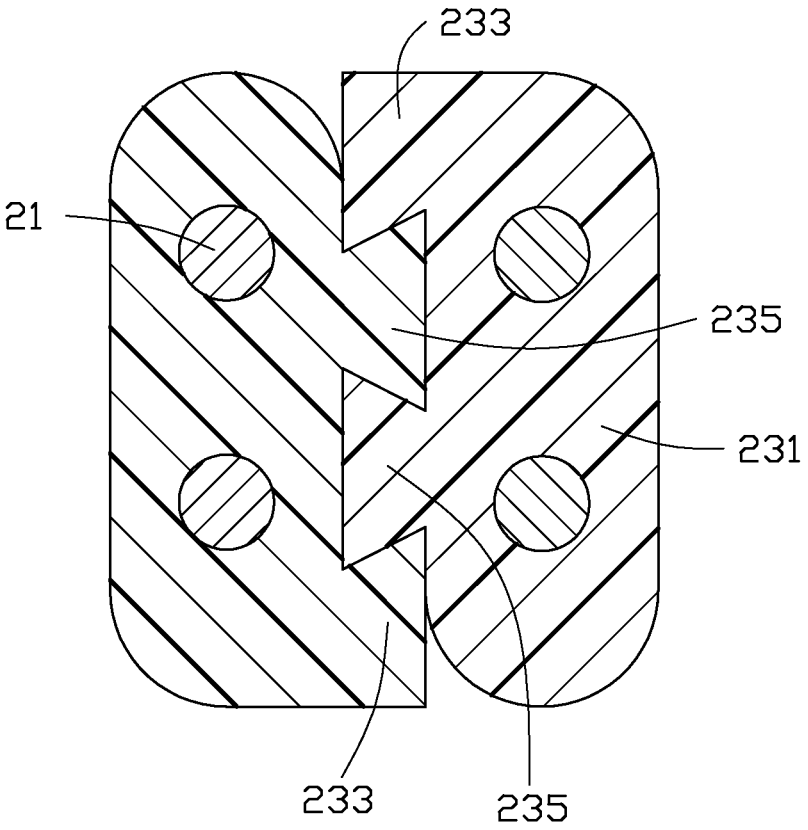
FIG. 3 is an enlarged cross section of the cords of the earphone assembly of FIG. 1, taken along line III-III thereof, whereat the cords are coupled together.

Also referring to FIG. 3, the cords 20 are coupled together in such a manner that the second latching part 235 of one of the cords 20 engages in the receiving groove 25 of the other cord 20. The inclined surfaces 2351 and 2353 of the second latching part 235 of one of the cords 20 respectively contact the inclined surface 2351 of the second latching part 235 and the inclined surface 2331 of the first latching part 233 of the other cord 20. The outer surface 2333 of the first latching part 231 and the outer surface 2352 of the second latching part 235 of one of the cords 20 contact the inner flat side 2310 of the main body 231 of the other cord 20. Due to the configurations of the second latching parts 235 and the receiving grooves 25, the second latching part 235 of each cord 20 is locked in the receiving groove 25 of the other cord 20, and the cords 20 are gathered up as a unified strand.

Referring to FIG. 1 again, to conveniently zip or unzip the cords 20, the zipper 40 is provided. The zipper 40 includes a supporting wall 41, and two bending walls 45 bending inwardly from two opposite sides of the supporting wall 41. The supporting wall 41 and the bending walls 45 cooperatively enclose the cords 20. The zipper 40 further includes a prismatic protrusion 43 protruding from a middle of the supporting wall 41, to guide the cords 20 to zip or unzip. The bending walls 45 are located at opposite sides of the protrusion 43, and are each spaced from the protrusion 43 a narrow distance. When drawing the zipper 40 towards the earphones 30, the bending walls 45 of the zipper 40 compress the cords 20 to make the second latching part 235 of one of the cords 20 engage in the receiving groove 25 of the other cords 20 so that the cords 20 are gathered up as a single unified strand. When drawing the zipper 40 towards the electrical connector 10, the cords 20 gathered up are separated by the protrusion 43 into the two separate strands.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An earphone assembly comprising:

an electrical connector;

two earphones; and two cords electrically connecting the electrical connector with the earphones, each of the cords comprising two wires connecting the electrical connector with a corresponding earphone and a zip chain containing the wires, the zip chain of each cord comprising an elongated main body, and a first latching part and a second latching part protruding from the main body towards the other cord, a receiving groove being defined between the first and second latching parts for receiving the second latching part of the other cord when the two cords are engaged with each other in such a manner that the first and second latching parts of each cord block the second latching part of the other cord from escaping from the receiving groove;

wherein the first latching part has a right trapezoid cross section, and the cross section of the second latching part is an isosceles trapezoid, the first latching part comprises a first surface perpendicularly extending from the main body, a second surface obliquely extending from the main body, and a third surface connected to the first surface and the second surface, the second latching part comprises two inclined surfaces obliquely extending from the main body and an outer surface connected to the two inclined surfaces, and the receiving groove is defined between the second surface of the first latching part and one of the inclined surfaces of the second latching part adjacent to the second surface of the first latching part.

2. The earphone assembly of claim 1, wherein the second latching part of each cord abuts against the second surface of the first latching part and the inclined surface of the second latching part adjacent to the second surface of the first latching part when the two cords are engaged with each other.

3. The earphone assembly of claim 1, wherein the outer surface of the second latching part of each cord contacts an inner flat side of the main body of the other cord when the two cords are engaged with each other.

4. The earphone assembly of claim 1, wherein the third surface of the first latching part and the outer surface of the second latching part are coplanar with each other.

5. The earphone assembly of claim 1, wherein the second latching part of each cord has a width in a cross section gradually increasing along a direction away from the main body, the receiving groove of each cord having a cross section gradually converging outwards from the main body.

6. The earphone assembly of claim 1, wherein the cross sections of the second latching part and the receiving groove are substantially identical to each other so that the second latching part of each cord is fittedly received in the receiving groove of the other cord when the two cords are engaged with each other.

7. The earphone assembly of claim 1, wherein the main body of each cord is solid.

8. The earphone assembly of claim 1, further comprising a zipper, wherein the zipper comprises a supporting wall and two bending walls bending inwardly from two opposite sides of the supporting wall, the supporting wall and the bending walls cooperatively enclosing adjacent portions of the cords.

9. The earphone assembly of claim 8, wherein the zipper further comprises a protrusion protruding from the supporting wall towards a region between the cords near the adjacent portions of the cords to guide the cords to zip or unzip.

10. The earphone assembly of claim 9, wherein the protrusion has a generally prismatic configuration.

11. The earphone assembly of claim 1, wherein the zip chains of the cords are made of rubber.

12. An earphone assembly comprising:

an electrical connector;

two earphones; and two cords electrically connecting the electrical connector with the earphones, each of the cords comprising two wires connecting the electrical connector with a corresponding earphone and a zip chain enclosing the wires, the zip chain of each cord comprising an elongated main body, a first latching part, a second latching part spaced from the first latching part, and a receiving groove between the first and second latching parts, the receiving groove receiving the second latching part of the other cord when the two cords are engaged with each other, the receiving groove having a cross section converging in a direction away from the main body, the second latching part having a cross section diverging in a direction away from the main body;

wherein the first latching part has a right trapezoid cross section, and the cross section of the second latching part is an isosceles trapezoid, the first latching part comprises a first surface perpendicularly extending from the main body, a second surface obliquely extending from the main body, and a third surface connected to the first surface and the second surface, the second latching part comprises two inclined surfaces obliquely extending from the main body and an outer surface connected to the two inclined surfaces, and the receiving groove is defined between the second surface of the first latching part and one of the inclined surfaces of the second latching part adjacent to the second surface of the first latching part.

13. The earphone assembly of claim 12, wherein the second latching part has the same shape and size as the receiving groove.

14. The earphone assembly of claim 12, wherein an angle of the second surface of the first latching part relative to the main body is substantially equal to that of one of the inclined surfaces of the second latching part relative to the main body.

15. The earphone assembly of claim 12, further comprising a zipper, wherein the zipper comprises a supporting wall and two bending walls bending inwardly from two opposite sides of the supporting wall, the supporting wall and the bending walls cooperatively enclosing the cords.

16. The earphone assembly of claim 15, wherein the zipper further comprises a protrusion protruding from a middle of the supporting wall towards a portion between the cords to guide the cords to zip or unzip.

17. The earphone assembly of claim 12, wherein the zip chains of the cords are made of rubber.

* * * * *